United States Patent [19]

Tonge

[11] 4,286,734

[45] Sep. 1, 1981

[54] LIQUID MIX DISPENSING GUN

[76] Inventor: Donald R. Tonge, 15 Dakota Grove, Totara Park, Upper Hutt, New Zealand

[21] Appl. No.: 58,176

[22] Filed: Jul. 17, 1979

[51] Int. Cl.[3] ..... B05B 7/30

[52] U.S. Cl. ..... 222/145; 222/630; 239/417.5; 239/433; 239/526; 239/600

[58] Field of Search ..... 222/630, 145; 239/526, 239/318, 600, 417.5, 433, 407

[56] References Cited

U.S. PATENT DOCUMENTS

| | | | |
|---|---|---|---|
| 1,318,813 | 10/1919 | Smith | 239/526 X |
| 1,610,714 | 12/1926 | Smith | 239/318 X |
| 3,107,858 | 10/1963 | Ganzel et al. | 239/526 X |
| 3,318,535 | 5/1967 | New | 239/600 X |
| 3,758,039 | 9/1973 | Wagner | 239/372 |
| 3,876,150 | 4/1975 | Dwyer et al. | 239/600 X |
| 4,129,231 | 12/1978 | Larson | 222/145 |

FOREIGN PATENT DOCUMENTS

| | | | |
|---|---|---|---|
| 2238019 | 2/1974 | Fed. Rep. of Germany | 239/526 |

*Primary Examiner*—Robert J. Spar
*Assistant Examiner*—Frederick R. Handren
*Attorney, Agent, or Firm*—Holman & Stern

[57] ABSTRACT

The invention relates to a liquid mix dispensing gun which is constructed in a novel manner. The gun which has a hand grip and barrel region can receive two distinct liquids and during the course of the travel thereof throughout the housing of the gun one liquid is entrained in the other prior to issuing from the dispensing nozzle. The mode of construction is such that two simple molded housing parts encase and locate at least substantial portions of a nozzle part, a valving mechanism and conduiting, whereby a maximum number of simple molded parts can be utilized.

4 Claims, 6 Drawing Figures

A
A
1
2
3
4
5
6
7
8
9
10
11
12
13
14
15
16
17
18
19
20
21
21A

LIQUID MIX DISPENSING GUN

BRIEF SUMMARY OF THE INVENTION

The invention relates to a liquid mix dispensing gun having the facility to receive and mix prior to dispensing two different liquids, the dispensing gun itself being formed from a plurality of moulded parts of which two are housing parts which encase substantially all of the other parts.

Venturi type mixing arrangements have long been known whereby a flow of one liquid can entrain a secondary flow of liquid therein. Such a principle has often been utilised where, for example, a water flow is required to pick up as the need arises a second liquid such as a detergent, sanitizing agent or the like. No fully effective cheap to manufacture dispensing gun has been devised however which will not only be attractive in appearance, robust and still leave an operator unfettered to any great extent by conduiting leading to the dispensing gun.

It is therefore an object of the present invention to provide a liquid mix dispensing gun for the purpose described which can be assembled using a plurality of moulded parts, at least two of the parts being housing parts which do not in their assembled state themselves have to generate any fluid tight conduiting save possibly at connection points.

In one aspect the present invention consists in a liquid mix dispensing gun having the facility to receive and mix prior to dispensing two different liquids, said gun comprising a housing formed in two parts, said parts being capable of being moulded and of being combined to define a hand grip and barrel region, each part substantially defining a side of the housing, a valving mechanism not forming a portion of said housing parts located between the housing parts and having means to control the operation of the same accessable externally of said housing, a nozzle part not formed as a portion of said housing parts, located between the housing parts, said nozzle part including means defining a main conduit, means defining a nozzle outlet at an end of said main conduit, means defining a first inlet to said main conduit, means defining a second conduit in communication with said main conduit and means defining a second inlet, which said second inlet is into said second conduit, means providing a fluid tight conduit from said valving mechanism to said first inlet, said conduit passing between the housing parts along the barrel region from said valving mechanism towards the end thereof at which said nozzle outlet is positioned, means to facilitate a fluid tight feed of a first liquid via lower regions of said hand grip to said valving mechanism, the arrangement being such that in use a first liquid passes through said valving mechanism in a controllable manner to said first inlet and from thence via said main conduit out of said nozzle outlet, and means to facilitate the feeding to said second inlet of said nozzle part of second liquid which enters said housing from lower regions of said hand grip, the whole arrangement thus being such that upon a controlled dispensing of said first liquid out of said nozzle outlet, quantities of said second liquid are entrained in the stream of said first liquid as the same passes along said main conduit.

In a further aspect the invention consists in a liquid mix dispensing gun having the facility to receive and mix prior to dispensing two different liquids, said gun comprising, a housing formed in two parts, said parts being capable of being moulded and of being combined to define a hand grip and barrel region, each part substantially defining a side of the housing, a valving mechanism not forming a portion of said housing parts located at least partly between the housing parts, said valving mechanism including means defining a conduit having an inlet and an outlet and means capable of controlling the degree of opening of said valving mechanism conduit, said controlling means lying at least partly externally of said housing in such a way as to enable by hand operation control on the degree of opening of said valving mechanism conduit, a nozzle part not formed as a portion of said housing parts located at least partly between the housing parts, said nozzle part including means defining a main conduit, means defining a nozzle outlet at an end of said main conduit, means defining a first inlet to said main conduit which is within said housing, means defining a second conduit in communication with said main conduit and means defining a second inlet within said housing to said second conduit, means positioned between the housing parts and independently of said housing providing a fluid tight conduit from said valving mechanism outlet to said first inlet of said nozzle part, said means passing between the housing parts along the barrel region, means independently of said housing capable of feeding in a fluid tight manner a first liquid from lower regions of said hand grip to the inlet of said valving mechanism, the arrangement being such that in use a first liquid can be passed through said hand grip to the inlet of said valving mechanism and from thence in a controllable manner to said first inlet and from thence via said main outlet of said nozzle outlet, and means independently of said housing parts capable of feeding in a fluid tight manner a liquid from lower regions of said hand grip along the barrel to said second inlet of second nozzle part, the whole arrangement being such that in use a feed of said first and second liquid can be supplied to lower regions of said hand grip and quantities of said second liquid are entrained in the stream of said first liquid as the same passes along said main conduit.

In a further aspect the present invention consists in a method of manufacturing a liquid mix dispensing gun having facility to receive and mix prior to dispensing two different liquids, said gun comprising a housing formed in two parts, said parts being capable of being moulded and of being combined to define a hand grip and barrel region, each part substantially defining a side of the housing, a valving mechanism not forming a portion of said housing parts located at least partly between the housing parts, said valving mechanism including means defining a conduit having an inlet and an outlet and means capable of controlling the degree of opening of said valving mechanism conduit, said means lie at least partly externally of said housing in such a way as to enable by hand operation control on the degree of opening of said valving mechanism conduit, a nozzle part not formed as a portion of said housing parts located at least partly between the housing parts, said nozzle part including means defining a main conduit, means defining a first inlet to said main conduit which is within said housing, means defining a second conduit in communication with said main conduit and means defining a second inlet within said housing to said second conduit, means positioned between the housing parts and independently of said housing providing a fluid tight conduit from said valving mechanism outlet to said first inlet of said nozzle part, said means passing between the housing parts along the barrel region, means independently of said housing capable of feeding in a fluid tight manner a first liquid from lower regions of said hand grip to the inlet of said valving mechanism, the arrangement being such that in use a first liquid can be passed through said hand grip to the inlet of said valving mechanism and from thence in a controllable manner to said first inlet and from thence via said main outlet out of said nozzle outlet, and means independently of said housing parts capable of feeding in a fluid tight manner a liquid from lower regions of a hand grip along the barrel to said second inlet of second nozzle part, the whole arrangement being such that in use a feed of said first and second liquid can be supplied to lower regions of said hand grip and quantities of said second liquid are entrained in the stream of said first liquid as the same passes along said main conduit, said method comprising the steps of manufacturing the component parts comprising the separate housing parts, the valving mechanism and said nozzle part and linking with flexible plastic tubing in an appropriate way the various inlets and outlets and subsequently closing on the thus connected components the two housing parts and fastening the same together.

In a further aspect the present invention consists in a liquid mixing dispensing gun having the facility to receive and mix prior to dispensing two different liquids said gun comprising a housing forming in two parts, said parts being capable of being moulded and of being combined to define a hand grip and barrel region, each part substantially defining a side of the housing, a valving mechanism not forming a portion of said housing parts but which is located at least partly between the housing parts, said valving mechanism including means defining a conduit between an inlet and an outlet, said outlet of which is capable of receiving a first liquid via lower regions of said hand grip or is at least capable of passing a first liquid along the conduit of the valving mechanism via lower regions of said hand grip, and means located at least partly externally of said housing so as to be capable of manual operation which is operative to control the degree of opening of said conduit, the nozzle part not formed as a portion of said housing parts located at least partly between the housing parts, the said nozzle part including means defining a main conduit, means defining a first inlet to said main conduit, means defining a second conduit in communication with said main conduit and means defining a second inlet which said second inlet is into said second conduit, means independently of said housing parts provide a fluid tight conduit from said valving mechanism outlet to said first inlet of said nozzle part, said conduit passing between the housing parts along the barrel region from said valving mechanism, and means to facilitate the feeding to said second inlet of said nozzle part a second liquid which enters said housing from lower regions of said hand grip, the whole arrangement being such that upon a controlled flow of said first liquid through the main conduit of said nozzle in use quantities of said second liquid are entrained therein.

DETAILED DESCRIPTION

In the preferred form of the present invention the liquid mix dispensing gun is formed largely from moulded parts. The moulded parts include each housing part which can be brought together to define a gun shaped housing which is held together preferably by screws which pass into and through one housing part and are received in the other. Obviously rivets or any form of adhesive fix could be used but this would preclude or at least inhibit any servicing of the interior of the liquid mix dispensing gun.

Figures 1, 2:
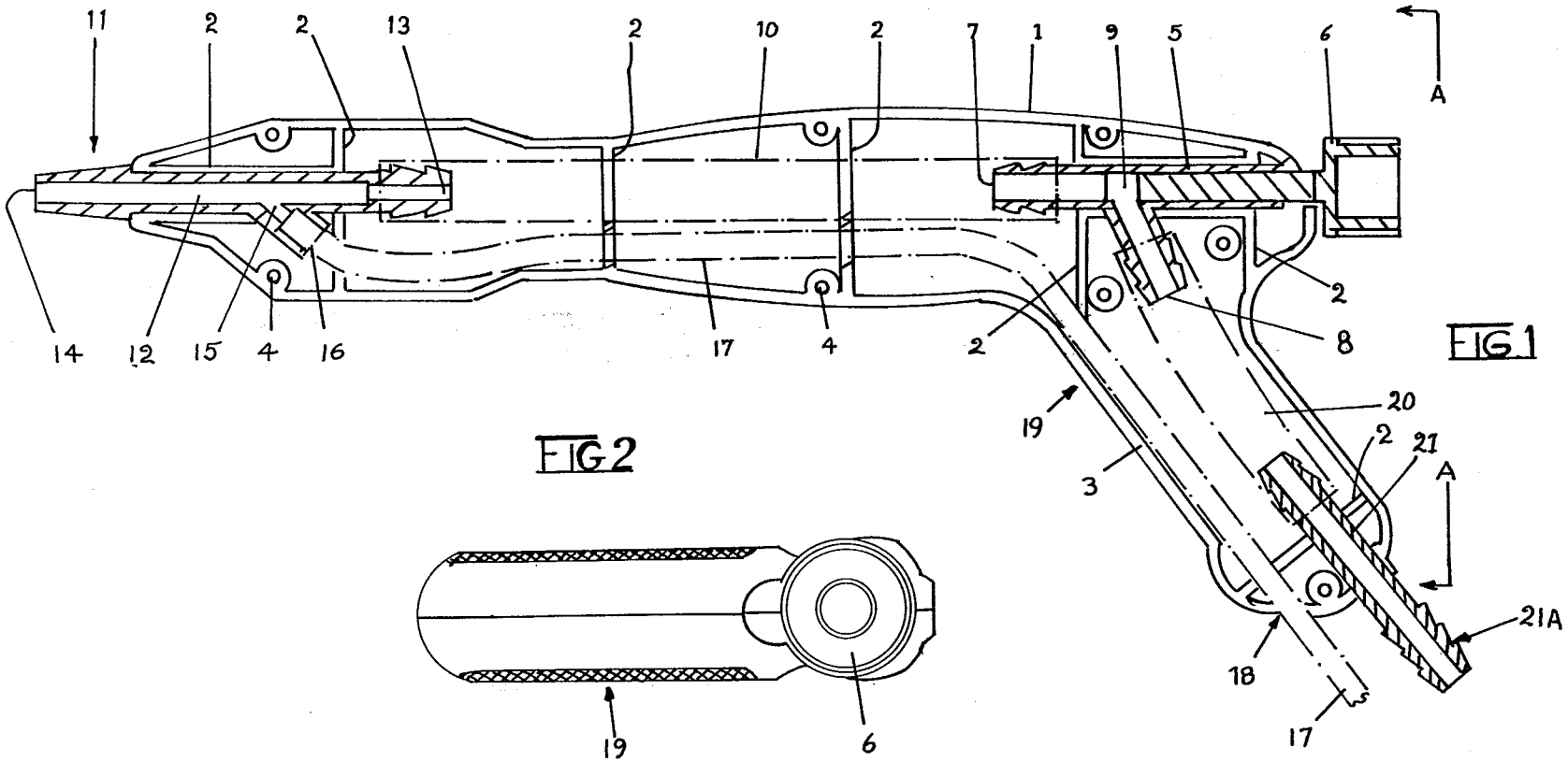
FIG. 1 shows a side view partly in cross-section of a liquid mix dispensing gun in accordance with the present invention, the view being such that the top most side housing part has been removed to reveal in section the valving mechanism and the nozzle part and showing with dotted outlines the various conduiting tubes.
FIG. 2 shows a view AA of a completed gun of the kind as shown in FIG. 1 but without the conduits or means for connecting conduits into the hand piece.
Figure 6:
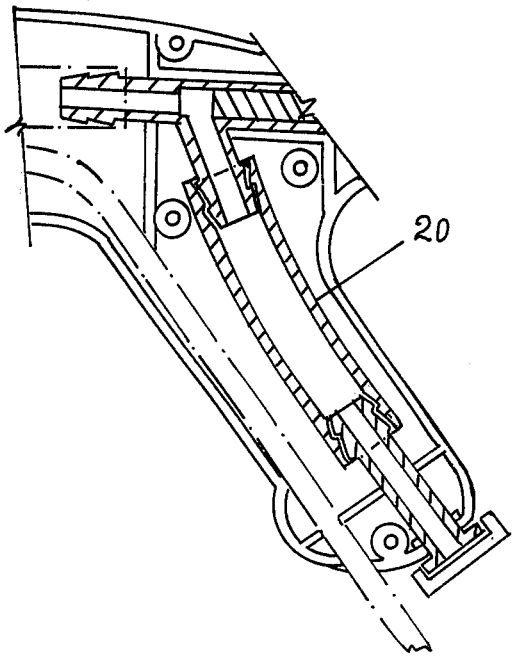
FIG. 6 shows a similar type bayonet fit diagrammatic arrangement but showing the same linked to a member located between the housing parts which differs from that shown in FIG. 1, otherwise the arrangement being substantially as shown in FIG. 1.

Other moulded parts are the nozzle part and the valving mechanism which can take many different forms. Also a further moulded part is, for example, in the forms of the invention as shown in FIGS. 1 and 6 a rigid conduiting attachment member which is separate from the valving mechanism. Also forming part of a liquid mix dispensing gun in accordance with the present invention are the various plastic tubes.

In order to achieve the required entraining of the second liquid in the main stream, various options are open which would also give rise to some mass production capabilities. However in order to provide an aesthetic and easily to handle dispensing gun which also allows a control on the primary liquid flow an arrangement of the kind hereinafter disclosed have been chosen. It is clear that if the flow control is after the mixing of the two liquids takes place the pressurized first liquid, for example, a source of pressurized water, would feed back down through the conduiting for the second liquid which ideally is not under pressure. This is because it is envisaged that the tube which will duct the second liquid to the mixing region of the nozzle part will simply be lowered, for example, into a bottle or other container of some detergent or the like which is to be entrained and mixed with the primary liquid prior to dispatch.

Referring specifically to the drawings it can be seen that one of the two housing parts 1 provides with a plurality of ribs 2 means which will locate in appropriate contouring thereof the various members and will hold the same firmly in such condition with complementary ribs of the other housing part which when assembled will be held flat against the peripheral flange 3 of the housing part 1 and fix thereto by, for example, a plurality of screws which screw into holes 4 of the housing part 1.

Referring to FIG. 1 it can be seen that the valving mechanism is for example a moulded member 5 (it is shown in section as also is the adjusting knob and screw member 6) and has an outlet 7 and an inlet 8 which is connected by conduit 9 to the outlet 7. The degree of opening however of the conduit 9 is controlled by the degree of screwing in of the screw member 6 which is actuable from the exterior to fully open or fully close the conduit 9 and thus the feed of primary or first liquid (usually water) along the tubing conduit 10 to the nozzle piece 11. As can be seen in FIG. 1 the means of adjustment of the valving mechanism is at a position which does not interfere with the holding of the dispensing gun. Similarly with the inlets or the like to the gun of the two liquids.

The nozzle part 11 itself includes means defining a main conduit 12, an inlet 13 thereto and a nozzle outlet 14. It also includes a second conduit 15 having an inlet thereto 16 to which is connected the conduiting 17 (preferably a flexible plastics tube) which in the preferred form of the present invention is continued for some considerable length beyond the butt region 18 of the hand grip 19. The length of tubing 17 beyond the butt region 18 is such that the same can be lead away and into, for example, some container of the second liquid.

The conduit 10 between the outlet 7 of the valving mechanism 5 and the inlet 13 of the nozzle part 11 is preferably a flexible plastics member capable of being push fitted over each end region and retained thereover in a water tight manner to facilitate assembly. Similarly with the conduiting 20 which is ideally of a similar kind to that of conduit 10 which in one form of the invention is located in a push on manner over the inlet 8 to the conduit 9 of the valving mechanism and over by way of example a rigid member 21 which would be located between the housing parts and arranged so as to provide externally of the gun a region 21A to which some flexible conduit could be push fitted and which could in turn be connected to a primary liquid feed, for example, a water tap.

Figure 3:
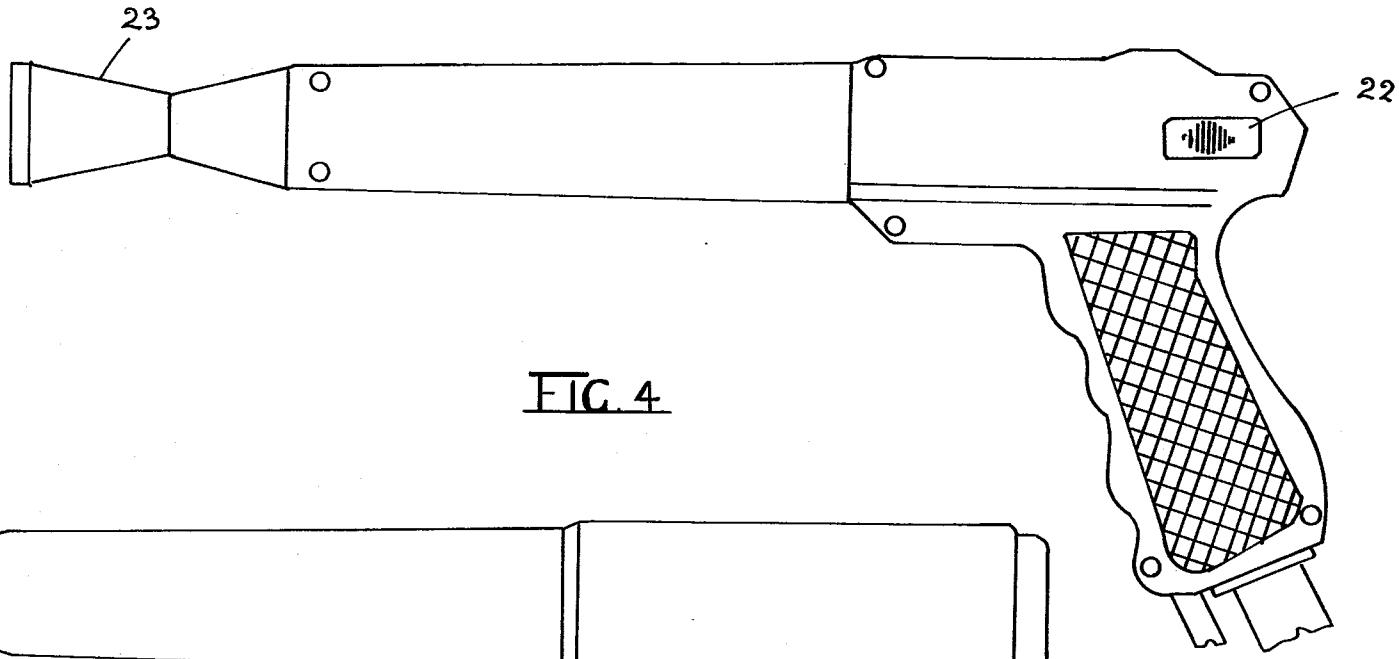
FIG. 3 shows the housing of a liquid mix dispensing gun in accordance with the present invention which varies from the configuration as shown in FIGS. 1 and 2 in that it not only has a slightly different housing shape but the means to allow the external controlling of the valving mechanism is the sliding member disposed to one side of the assembled housing rather than a screw-threaded adjusting member as in FIGS. 1 and 2, FIG. 3 also including by way of an example a different nozzle end.
Figure 4:
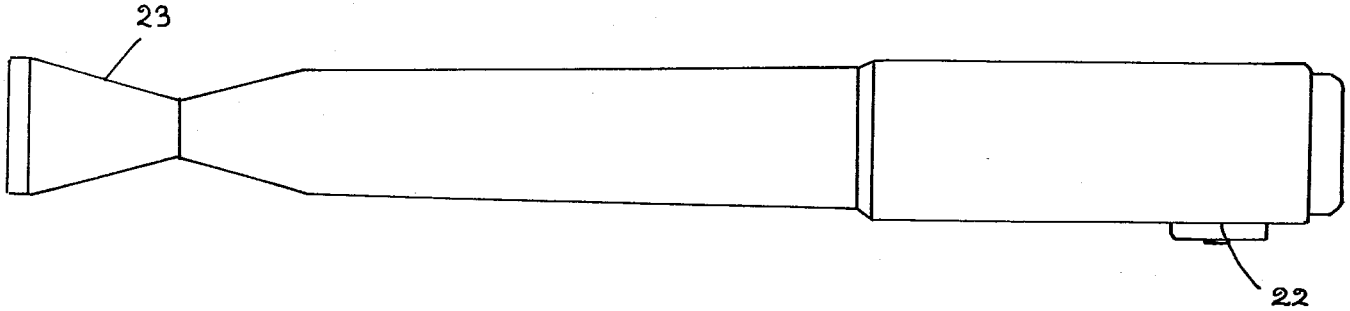
FIG. 4 is a top view of a liquid mix dispensing gun of the kind as shown in FIG. 3.
Figure 5:
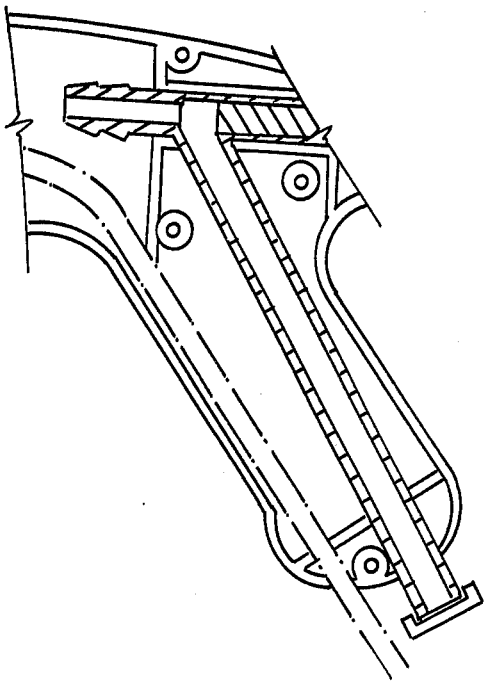
FIG. 5 is a partial cross-sectional view similar to that shown in FIG. 1 but showing an alternative form of valving mechanism member to that shown in FIG. 1, the valving mechanism member extending down to and possibly beyond the butt of the hand piece to allow the connection of the main or first liquid feed thereto, the end of that member being shown diagrammatically to signify for example a bayonet fit arrangement.

From the foregoing then the concept of the present invention can be readily visulized. Obviously however departures can occur, see for example FIGS. 3 and 4 where instead of a member 6 some alternative means (not shown) of controlling the flow of the primary liquid to the inlet 13 of the nozzle part could be provided and the external means of controlling the same could be for example a safety catch type slide member 22. Also shown in FIGS. 3 and 4 is a different type of nozzle for barrel end 23. This member could, for example, form part of the nozzle part 11 itself or could be a member which connects onto the end thereof or which forms part of the housing parts. Alternative forms of conduiting for the primary liquid to the valving mechanism are shown by way of example in FIGS. 5 and 6. In FIG. 5 a rigid extension of the means defining the inlet 8 and the conduit therefrom has been extended down to and possibly beyond the butt region 18 thus allowing some form of attachment of the conduit thereto. FIG. 5 shows diagrammatically how, for example, a bayonet fit type arrangement could be provided at the end thereof or, for example, some form of screw arrangement could be provided. FIG. 6 shows a similar variation in as far as the means of connection is concerned but FIG. 6 shows a retention of the flexible conduit 20 of FIG. 1. Obviously other variations are possible. It is to be noted however that in all preferred forms of the present invention a permanent flexible conduiting extension beyond the butt region 18 for the secondary liquid occurs. Obviously in some preferred forms of the present invention the end of any inlet to the hand piece 19 for the primary liquid could be flush or indeed some distance into the hand piece for connection to an appropriate feeding conduit. It is important to note however that for ease of manufacture and for a reduction in moulding tolerances required all fluid tight conduiting is independent of the housing parts.

From the foregoing then it can be seen that by the adoption of the appropriate moulds a plurality of parts can be readily manufactured for easy assembly and fitting. Ideally all the conduiting is connected prior to the same being located in one of the two housing parts and prior to the other housing part being placed thereover and fixed to the first housing part. With some forms of the invention it may be appropriate to use adhesive or the like to firmly locate within the housing some of the members for example the nozzle part 11 or valving mechanism 5. Whatever the mode of assembly that is adopted however it can be seen that a cheaply manufactured liquid mix dispensing gun which has good flow control is provided.

What is claimed is:

1. A fluid mixing and dispensing gun having the facility to receive and mix prior to dispensing two different liquids comprising;

a molded housing formed in two parts adapted to be assembled together to form a hollow casing in the shape of a gun having a barrel region and a hand grip;

a valve unit separately formed and implaceable in said housing at the hand grip end of said barrel, said valve unit comprising a conduit having an inlet and an outlet, a valve means to control the flow of liquid in said conduit, and a valve control means external of said housing to control the position of said valve;

a nozzle unit separately formed and implaceable in said housing at the outer end of said barrel, said nozzle unit comprising a main conduit having an inlet at its inner end within said barrel and a nozzle outlet at its other end external of said barrel, a second nozzle unit conduit connected to said main conduit at one end and having a second inlet at its other end;

a first tube member implaceable within said barrel and adapted to be removably connected at its ends in fluid tight engagement with said valve unit conduit outlet and said nozzle main conduit inlet;

a liquid hose connector separately formed and implaceable within the lower portion of said hand grip of said housing comprising a conduit having an inlet at one end external to said housing and an outlet at its other end within said housing;

a second tube member implaceable within said housing and adapted to be removably connected in fluid tight engagement at its ends to said connector outlet and said valve unit conduit inlet;

flexible tubing removably implaceable at its outlet end portion within said housing and adapted to be connected at its outlet end in fluid tight engagement with said nozzle unit conduit second inlet, said flexible tubing extending through the lower portion of said hand grip; and said gun when assembled being such that when a first liquid is fed through said hose connector valve unit and nozzle unit and said flexible tubing is connected to a source of second liquid, said second liquid is drawn into and mixed with the stream of first liquid within said nozzle unit.

2. A dispensing gun as claimed in claim 1 wherein said flexible tubing extends beyond lower regions of said hand grip and is insertible into a container of said second liquid.

3. A dispensing gun as claimed in claim 1 wherein said valve means is positioned in said valve unit to adjust the flow through said valve unit conduit from open to close and said valve control means extends externally of said housing and is hand adjustable to adjust the desired degree of opening of said conduit.

4. A dispensing gun as claimed in claim 1 wherein said two housing parts are held together by fixing means selected from the group consisting of rivets, screws, nuts and bolts and adhesive.

* * * * *